US006068114A

United States Patent [19]

Zimmerman et al.

[11] Patent Number: 6,068,114

[45] Date of Patent: May 30, 2000

[54] CONTAINER PACKAGE WITH SPOONS

[75] Inventors: John Zimmerman, Scarborough; Kenneth Anthony Sears, Cobourg; Robert David Dunn, Whitby, all of Canada

[73] Assignee: Kraft Canada, Inc., Don Mills, Canada

[21] Appl. No.: 09/379,061

[22] Filed: Aug. 23, 1999

[51] Int. Cl.[7] ..... B65D 75/00

[52] U.S. Cl. ..... 206/216; 206/427

[58] Field of Search ..... 220/212, 212.5; 206/216, 217, 427, 429, 430, 434, 541, 372

[56] References Cited

U.S. PATENT DOCUMENTS

| | | | |
|---|---|---|---|
| 1,607,863 | 11/1926 | Betts . | |
| 1,625,335 | 4/1927 | Schneider . | |
| 1,633,605 | 6/1927 | Prudden . | |
| 2,207,520 | 7/1940 | Rohody | 206/56 |
| 2,453,393 | 11/1948 | Wilson | 229/1.5 |
| 2,475,294 | 7/1949 | Rafoth | 229/1.5 |
| 2,509,616 | 5/1950 | Rafoth et al. | 229/36 |
| 2,598,987 | 6/1952 | Frazen | 229/43 |
| 2,843,259 | 7/1958 | Metzger | 206/47 |
| 3,458,107 | 7/1969 | Lane et al. | 229/1.5 |
| 3,828,999 | 8/1974 | Humphrey | 229/1.5 |
| 3,955,742 | 5/1976 | Marshall et al. | 229/1.5 |
| 4,060,176 | 11/1977 | Tobiasson | 220/212 |
| 4,218,010 | 8/1980 | Ruff | 229/43 |
| 4,339,033 | 7/1982 | Cillario | 206/216 |
| 5,044,498 | 9/1991 | Galiegue et al. | 206/427 X |
| 5,620,094 | 4/1997 | Naumann | 206/427 X |

*Primary Examiner*—Jacob K. Ackun
*Attorney, Agent, or Firm*—Thomas A. Marcoux; Thomas R. Savoie

[57] ABSTRACT

A sleeve-type package having upper and lower rows of individual product containing containers wherein the upper row is located within the tubular rectangular sleeve and the lower row has its container tops within the rectangular sleeve with the bottoms of the lower rows projecting down out of a cutout in the bottom of the rectangular sleeve. A generally flat spoon insert having a spoon panel with a plurality of spoon blanks and at least one protective panel is positioned within the rectangular sleeve between the upper and lower rows of product containers. Several embodiments of blanks with a plurality of spoons are shown and described.

33 Claims, 11 Drawing Sheets

FIG. 7
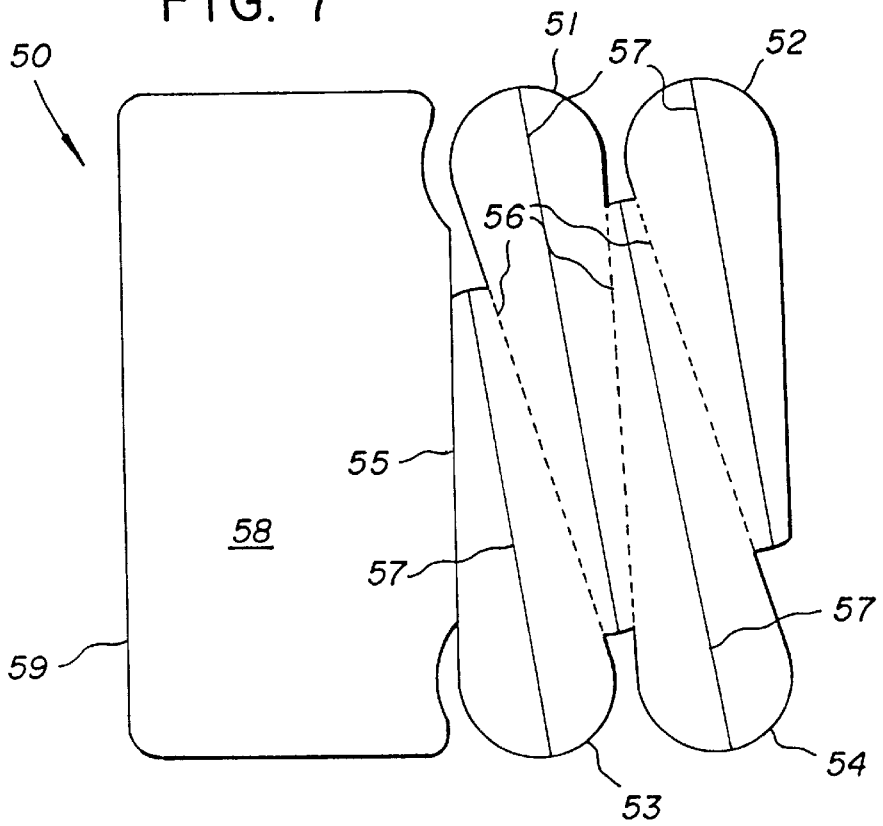
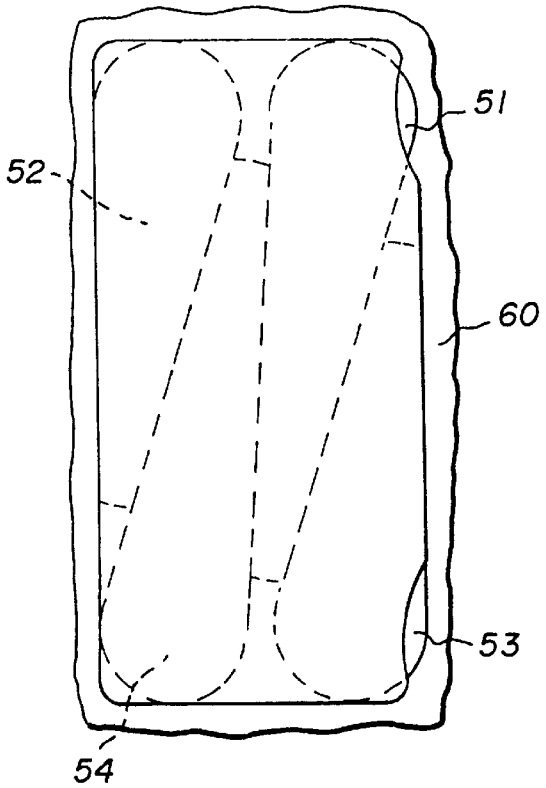
FIG. 8

FIG. 14
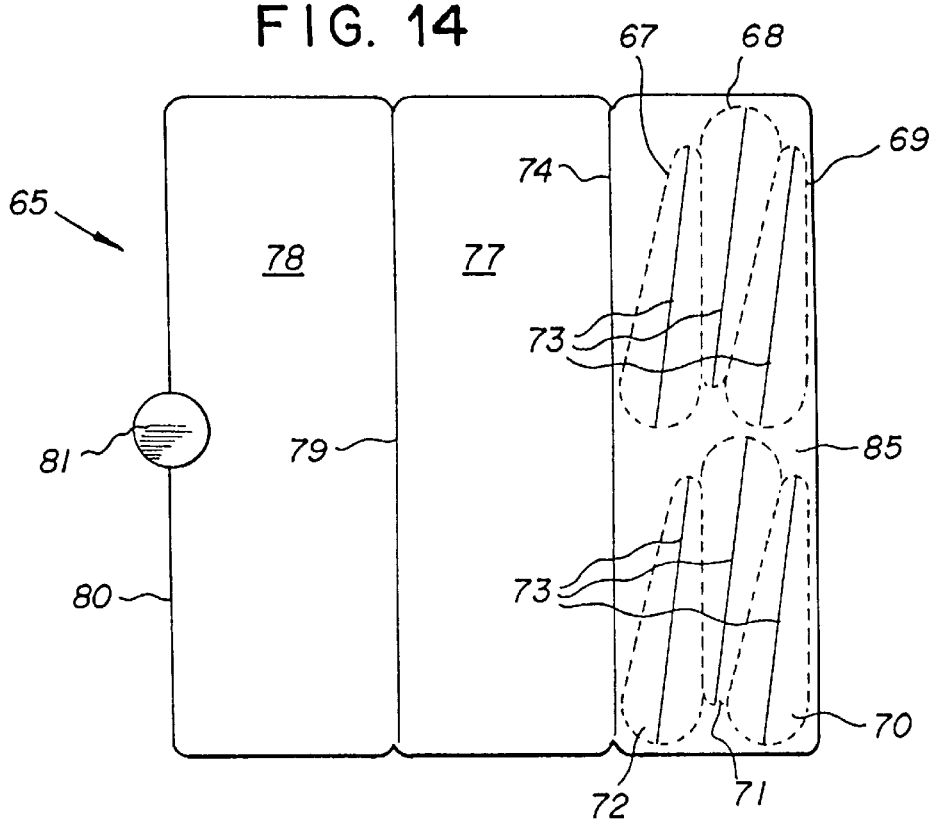
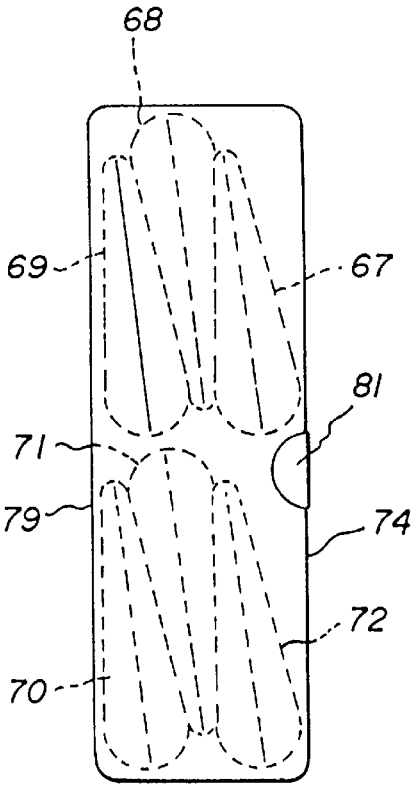
FIG. 15
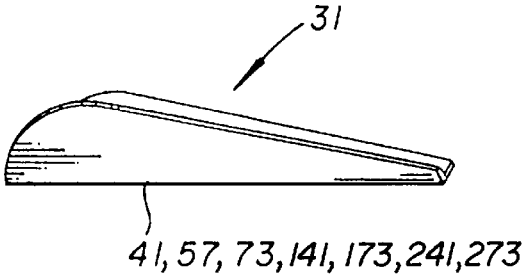
FIG. 20

FIG. 18
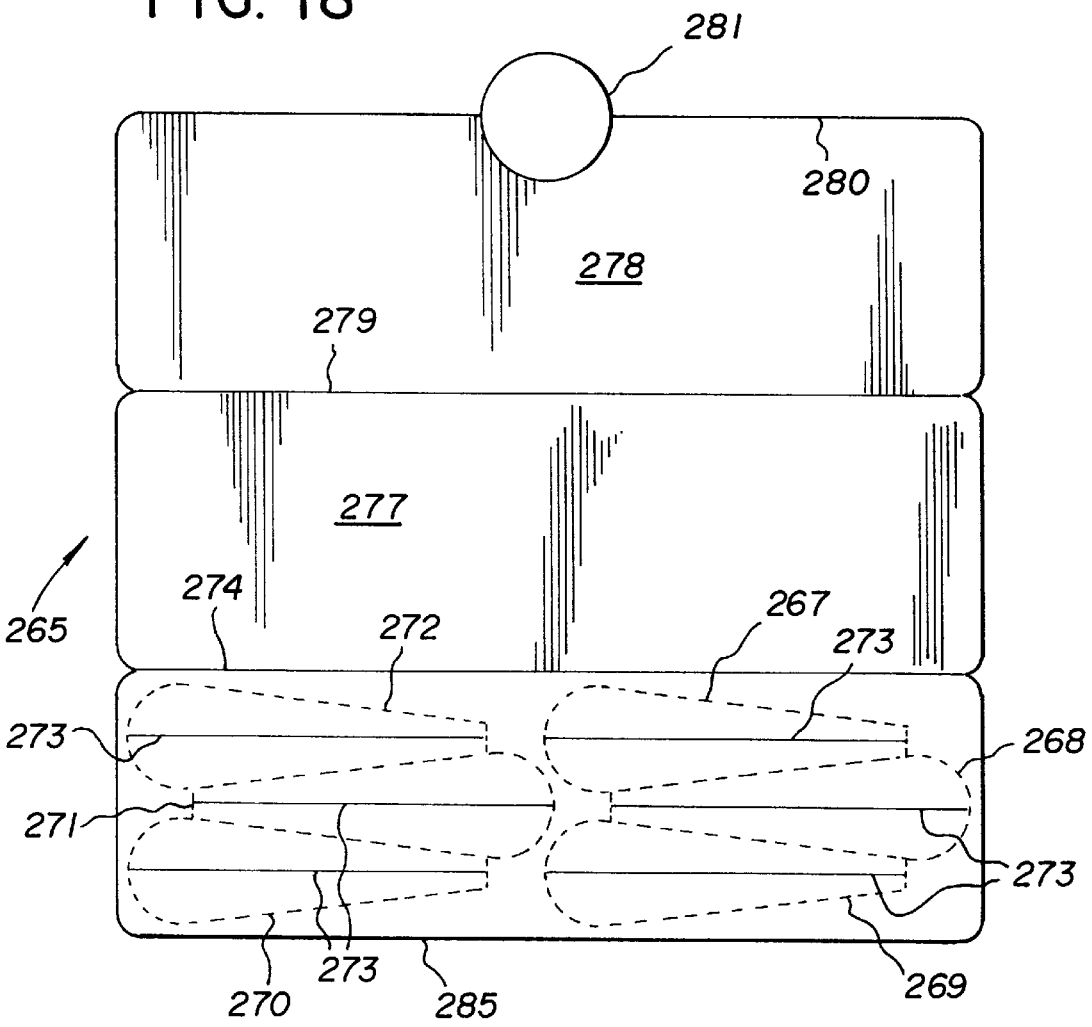
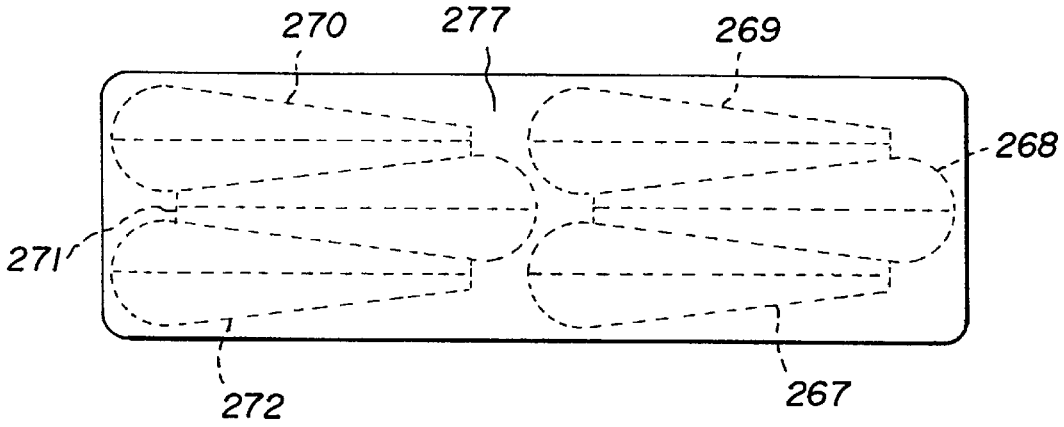
FIG. 19

CONTAINER PACKAGE WITH SPOONS

FIELD OF THE INVENTION

This invention relates to sleeve packages of the type which comprises a plurality of individual containers, and in particular it relates to providing disposable eating utensils such as spoons within the package for the containers; and it relates also to the spoons themselves.

BACKGROUND OF THE INVENTION

A specific type of sleeve-type package is well known for securing together a plurality of individual containers such as dessert containers or the like. This package comprises a tubular generally rectangular sleeve and the individual containers include a sealed top and a body portion extending downwardly therefrom, the cross section of which body portion is less that of the top. These packages comprise an upper and a lower row of containers, which rows may contain two, three or more individual containers. The upper row of containers is located totally within the sleeve with the tops of these containers secured through suitable openings near the top of the rectangular sleeve. The tops of the lower containers are secured within the sleeve, one beneath each container of an upper row, while a lower smaller body portion thereof extends outwardly through a cutout in the bottom of the sleeve.

One disadvantage of packages of this type is that it is necessary for the consumer to separately provide an eating utensil such as a spoon or the like for use with each container. While this presents no great disadvantage when the containers are opened and consumed within the home, it does create an inconvenience when the containers are taken for use outside of the home, such as at work, at school, at a picnic or the like.

Many types of packages have been devised which include spoons as a portion thereof. Such are shown for example in U.S. Pat. Nos. 2,475,294, 2,509,616, 2,843,259, 3,458,107 and 4,339,033. However, none of the arrangements shown therein are particularly suitable for use with a sleeve-type package of the type described.

Thus, a need exists for an improvement which will overcome the above-described disadvantages.

SUMMARY OF THE INVENTION

The purpose of the present invention is to provide a new and improved sleeve-type package containing individual containers which includes therein eating utensils such as spoons or the like, preferably disposable, and, preferably a spoon, for each individual container.

Another purpose of the present invention is to provide a new and improved spoon blank with a plurality of disposable spoons therein, preferably for use in a sleeve-type package of the type described.

In accordance with a preferred embodiment, the present invention provides a sleeve-type package with upper and lower rows of individual containers, with a spoon insert located within the sleeve between the upper and lower rows. This spoon insert preferably comprises at least two panels, one of the panels containing individual spoon blanks which are separable from each other, preferably one for each container, while at least one other panel provides protective support therefor. The spoon insert should be of a relatively stiff material.

One embodiment includes just two panels, namely a spoon panel and one protective panel. For this embodiment, it is preferable to protect the spoons by enclosing the spoon insert into a cover of some type, for example a flat bag or a shrink wrapped cover.

In another embodiment, the spoon panel has two protective panels adjacent thereto such that the spoon panel is folded into and maintained between the two protective panels. In this embodiment, a protective covering may be used but it is not necessary, and instead it is preferable to simply use an adhesive strip around the edges of the panels to hold them together.

For packages containing four containers, two in each row, the spoon panel of the spoon insert preferably comprises four spoons arranged side by side. For packages of the type having six containers, three in each row, the spoon panel preferably contains six spoons, three side by side at one end of the spoon panel and another three side by side at the other end of the spoon panel.

In all embodiments, it is preferable that the spoon insert substantially occupy the full length and width of the package, i.e. of the interior of the sleeve, thereby maximizing the available space for spoon blanks and concurrently providing additional rigidity to the package.

It is thus an object of the present invention to provide a new and improved sleeve-type package of the type containing a plurality of individual containers by providing a plurality of individual spoons directly within the package.

It is still another object of the present invention to provide improvements in sleeve-type packages which includes a spoon insert having at least two panels, one of which includes the spoon blanks, and the second and/or third of which panels protects the spoon panel.

It is still another object of the present invention to provide new and improved spoon blanks containing individual spoons adapted to be separated and used individually, together with at least one protective panel.

These and other objects will become apparent from the detailed description to follow of the preferred embodiments of the invention.

BRIEF DESCRIPTION OF THE DRAWING

There follows a detailed description of preferred embodiments of the present invention, which are to be taken together with the accompanying drawings, wherein:

FIG. 7 shows a blank of another embodiment of a spoon insert.

FIG. 8 shows the blank of FIG. 7 folded up into a spoon insert as it would be utilized in the sleeve-type package.

FIG. 14 shows another embodiment of a blank of a spoon insert, this one suitable for sleeve-type packages with six containers.

FIG. 15 shows the blank of FIG. 14, folded up into a spoon insert as it would be utilized in the sleeve-type package of FIG. 13.

FIG. 18 shows another embodiment of a blank of a spoon insert, this one suitable for the sleeve-type package with six containers.

FIG. 19 shows the blank of FIG. 18, folded up into a spoon insert as it would be utilized in the sleeve-type package of FIG. 13.

FIG. 20 shows an individual spoon removed from its blank and folded into the shape as it would be utilized.

DETAILED DESCRIPTION OF THE PREFERRED EMBODIMENTS

There follows a detailed description of the preferred embodiments, wherein like elements are represented by like numerals throughout the several views.

Figure 1:
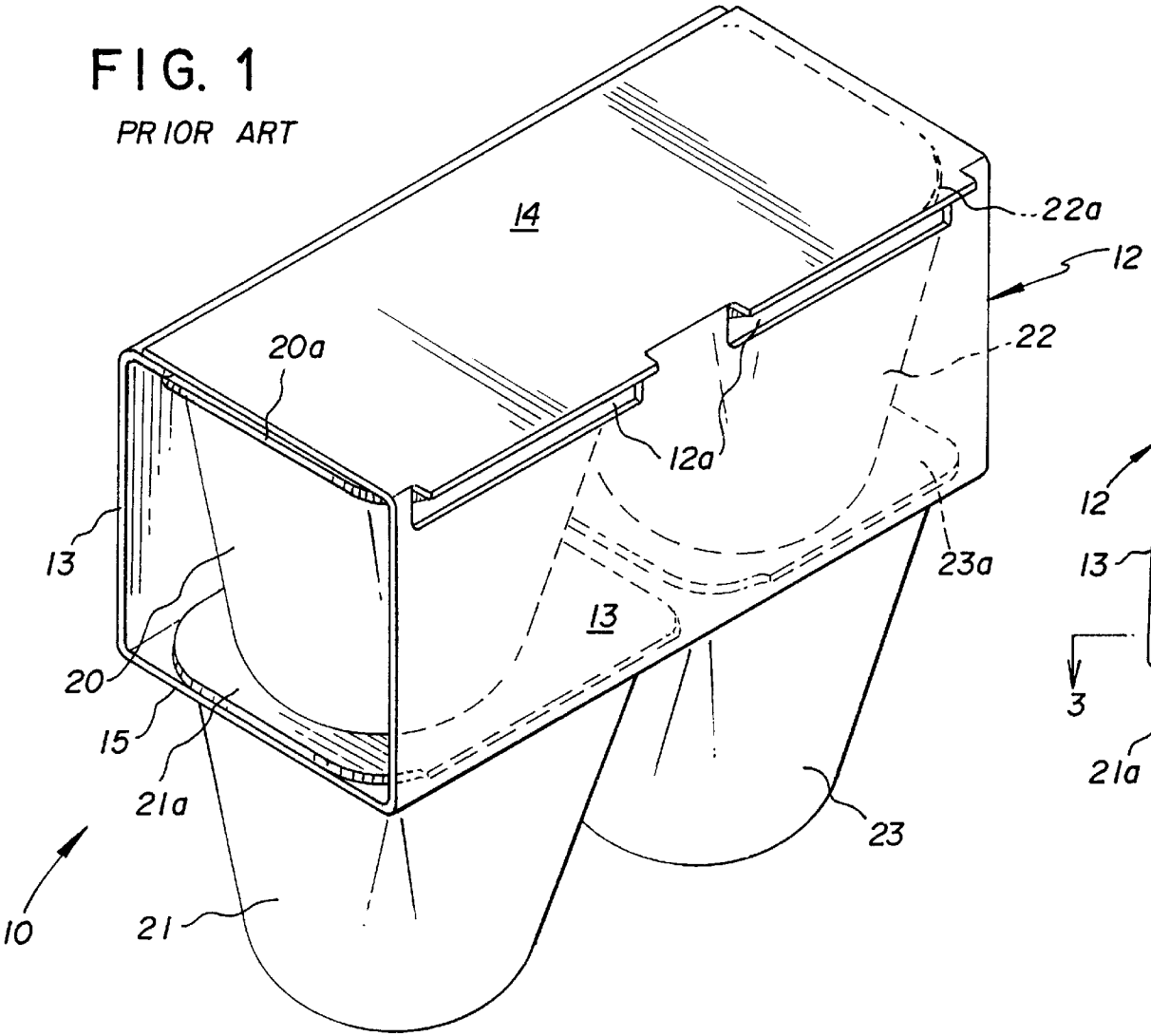
FIG. 1 PRIOR ART
FIG. 1 is a perspective view of a known sleeve-type package containing a plurality of individual containers.
Figure 4:
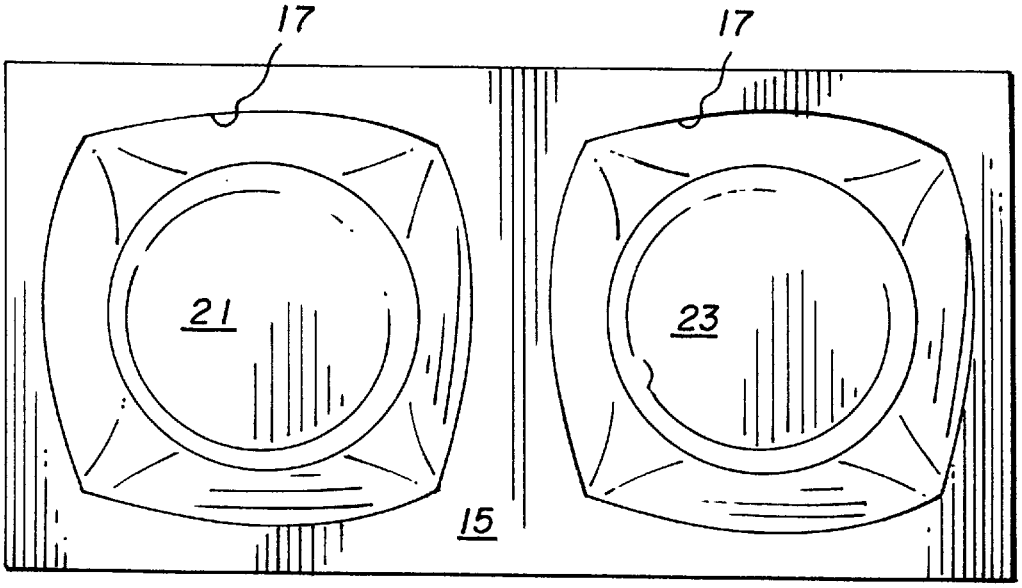
FIG. 4 is a bottom view of FIG. 2.

FIG. 1 illustrates a conventional sleeve-type package 10 containing a sleeve 12 which is a generally tubular member which, viewed from one end has a generally rectangular if not square cross section including sides 13, a top 14 and a bottom 15, and a plurality of product containers 20, 21, 22 and 23. The individual containers are each in the shape of a generally truncated cone with the larger upper end terminating in a generally flat top 20*a*, 21*a*, 22*a* and 23*a* which is closed by a membrane which seals the container, thus preserving the product therein which might be a food product such as gelatin, pudding or the like. In some commercial embodiments the bottoms of the containers are generally rectangular at the top, as shown in FIG. 4, while in other commercial embodiments the containers are actually more rounded at the top, shaped more like a true truncated cone.

Figure 2:
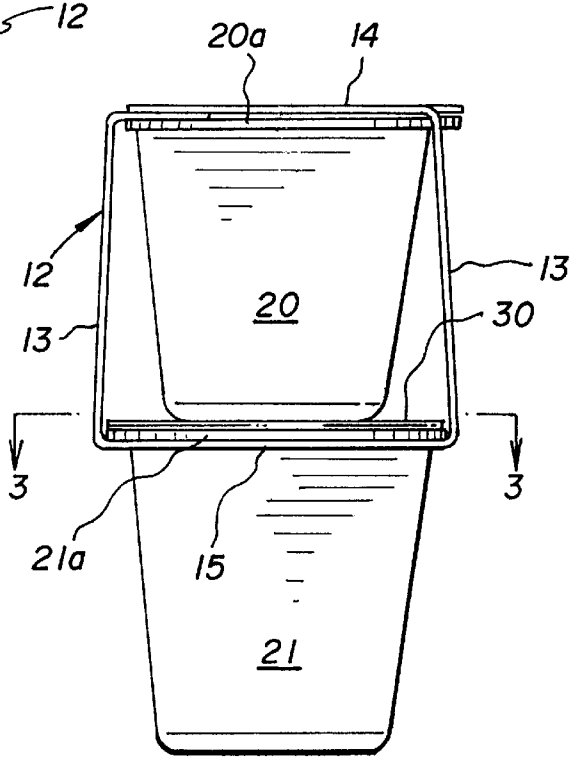
FIG. 2 is an end view of FIG. 1, but including the spoon insert of the present invention.

The upper row of containers 20 and 22 are generally contained entirely within the rectangular sleeve 12 and are secured therein by virtue of their tops engaging an opening at the top of one of the sides 13 of the rectangular sleeve as shown at 12*a* in FIGS. 1 and 2.

The containers 21 and 23 of the lower row are secured within the sleeve by virtue of their tops 21*a* and 23*a* being held at the bottom of the sleeve as the lower portions of those containers project outwardly through cutouts 17 which are of a size smaller than the outer dimensions of the tops 21*a* and 23*a*.

Figure 3:
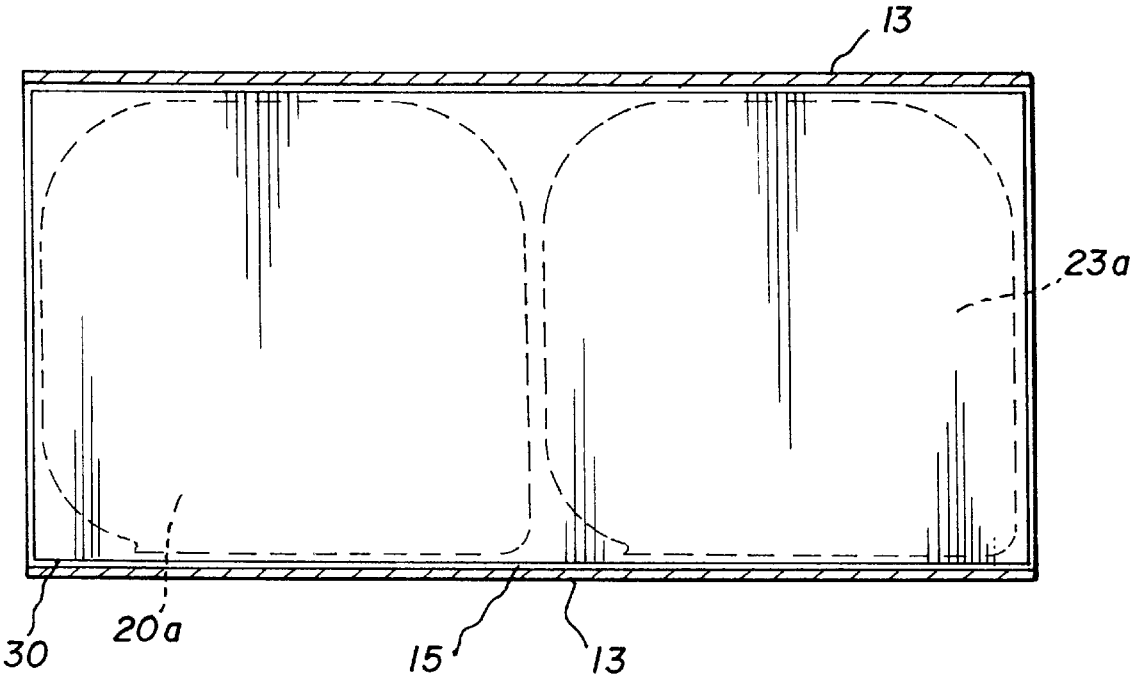
FIG. 3 is a sectional view taken along line 3—3 of FIG. 2.

In accordance with the present invention, as shown in FIGS. 2 and 3, a generally flat spoon insert 30 containing a plurality of spoons is inserted into the package, within the sleeve, between the upper and lower rows of containers. Apart from the advantage of providing disposable spoons, one for each container, this insert provides additional rigidity to the package.

As is apparent from FIG. 3, the spoon insert, in its form as inserted into the sleeve 12 is flat and generally rectangular, its length and width extending for essentially the full length and width of the interior of the sleeve 12.

Figure 5:
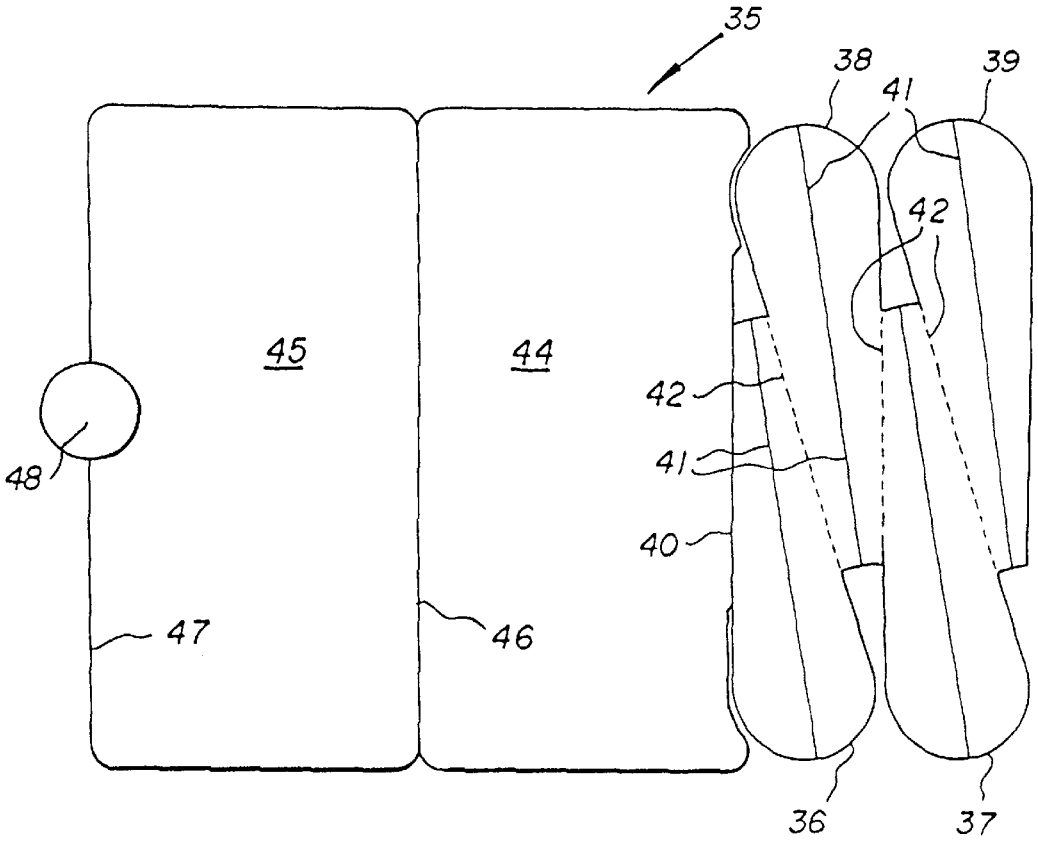
FIG. 5 shows a blank of a spoon insert containing a spoon panel with spoon blanks and a protective panel.
Figure 6:
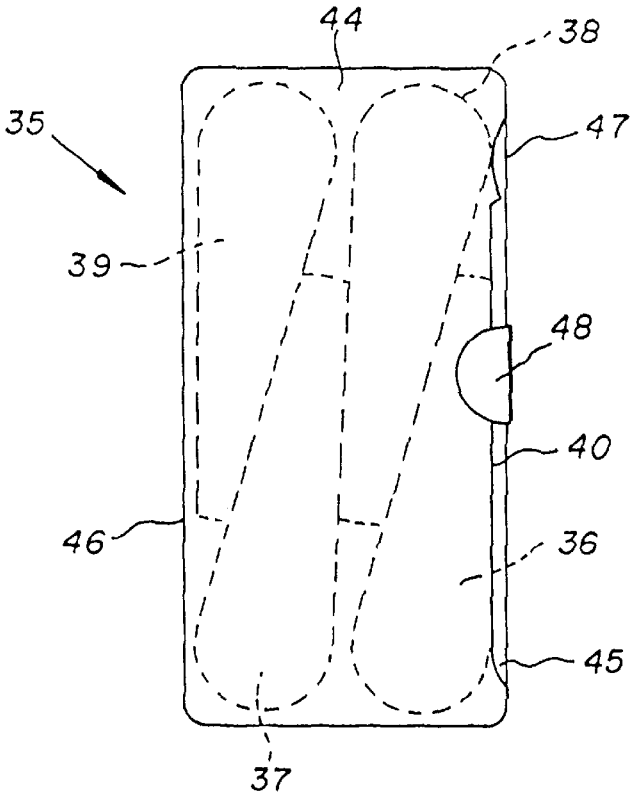
FIG. 6 shows the blank insert of FIG. 5, folded up into a spoon insert as it would be utilized in a sleeve-type package.

FIGS. 5 and 6 show a first embodiment 35 of a spoon insert. Referring to FIG. 5, there is shown a plurality of spoon blanks 36, 37, 38 and 39 which are secured together by weakened tear lines 42 while the spoon 36 is secured to an adjacent protective panel 44 along a fold line which is weakened and capable of being both folded and torn. Each of the spoons includes a fold line 41 along its center line. Adjacent to protective panel 44 is a second protective panel 45, separated by fold line 46. Second protective panel 45 terminates along an edge 47, and there is shown thereat an adhesive tab 48 which can be utilized to hold the insert together after the panels are folded upon each other.

Since the fold lines 40, 41 and 46 constitute cuts into the thickness of the material, all folds are in the opposite direction, i.e. away from the viewer and away from the plane of the figure.

The individual spoons, after being separated from the remainder of the spoon panel would be folded along a fold line 41 away from the plane of the figure to a shape as shown at 31 in FIG. 20. Naturally the smaller right-hand end would constitute the handle while the larger left-hand end would constitute the front, food engaging portion.

FIG. 6 illustrates the embodiment of FIG. 5, after being folded into a spoon insert to be inserted into the sleeve 12. The spoon panel, which is the area constituting the four spoons is folded downwardly away from the viewer, away from the plane of the figure, along fold line 40. After it then lies against the opposite side of panel 44, panel 45 is folded down along fold line 46 and over against the spoon panel. The resultant spoon insert is shown in FIG. 6, wherein the adhesive tab 48 will then attach edge 47 of panel 45 to the edge 40 between panels 44 and the spoon panel, the two protective panels 44 and 45 then securing and protecting the spoons themselves.

FIG. 7 illustrates another embodiment 50 of a spoon insert. Here, four spoon blanks 51, 52, 53 and 54 are arranged in a manner similar to the four spoon blanks in the embodiment of FIG. 5. They are separated from each other by weakened lines 56 and include central fold lines 57. They are separated by a fold line at edge 55 from a protective panel 58 which includes an opposite edge 59. For insertion into the sleeve, the spoon panel is folded downwardly along fold line 55 away from the viewer and away from the plane of the figure and around and against the back of panel 58 as shown in FIG. 8.

Since this embodiment includes only one protective panel, one surface of the spoon blanks 51–54 will be exposed. Thus, in use it might be preferable to enclose this particular insert into a protective covering. Such a covering, which is shown only schematically at 60 in FIG. 8, may take the form of a shrink wrap or simply a bag into which the spoon insert can be inserted.

Figure 9:
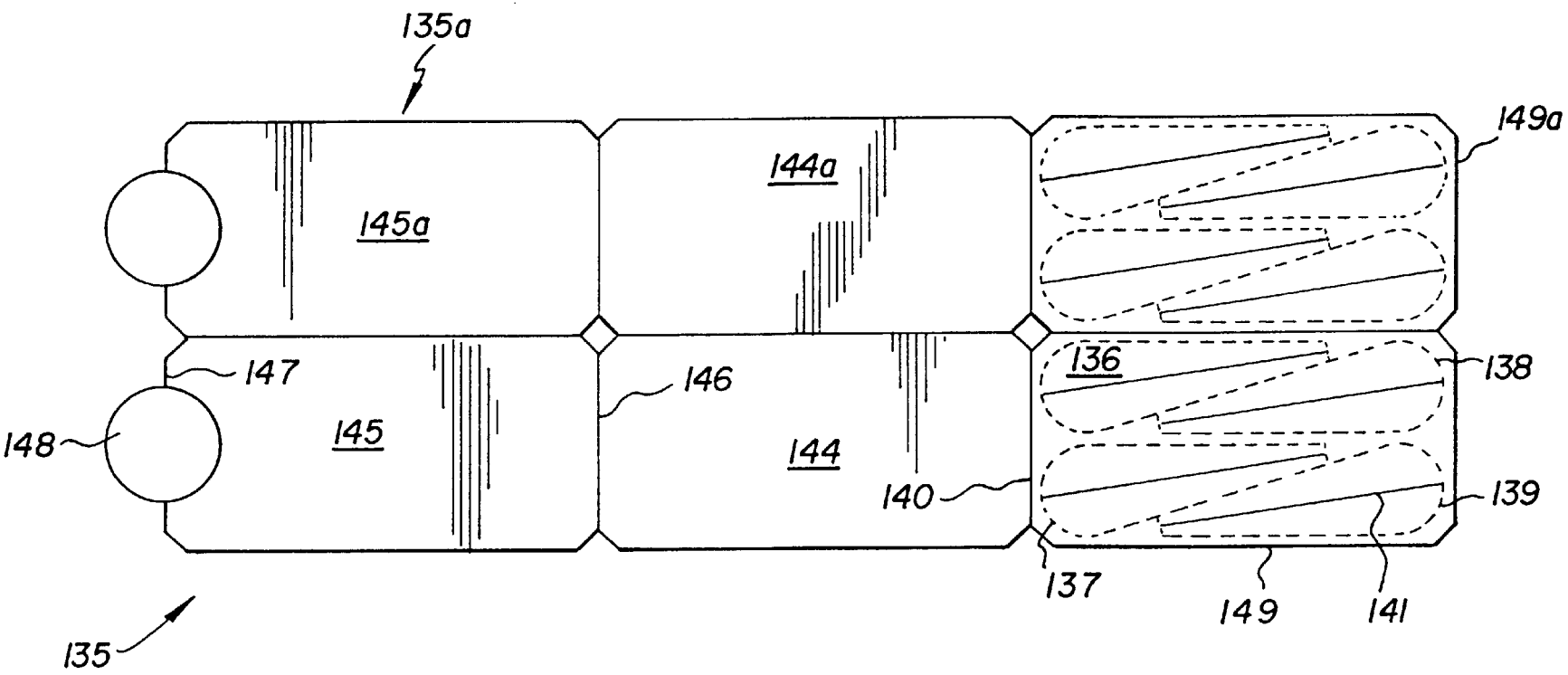
FIG. 9 shows a pair of blanks of another embodiment of a spoon insert.

FIG. 9 illustrates another embodiment 135 of a spoon insert. Since FIG. 9 is an improvement of a four spoon insert, this figure utilizes the same numerals as in FIGS. 5 and 6 for generally similar parts, but raised by 100. In this embodiment the spoons 136, 137, 138 and 139 are formed in the spoon panel 149, inwardly from all of the edges thereof. In this embodiment the three panels are arranged end to end rather than side by side, the spoon panel 149 separated from a center protective panel 144 by a fold line 140. Adjacent to panel 144 is another protective panel 145, separated therefrom by a fold line 146. At the opposite end of panel 145 is an edge 147 to which is attached an adhesive tab 148.

Also illustrated in FIG. 9 is a separate spoon insert 135*a*. This figure illustrates the advantage that spoon inserts of this type with the panels located end to end can be manufactured with two spoon inserts manufactured adjacent each other, separated by micro nicks which allow the two spoon inserts 135 and 135*a* to be easily separated from each other. This has the advantage of better feeding and line-up on the folder gluer, although of course they would have to be separated at some point before being inserted into the sleeve.

Figure 10:
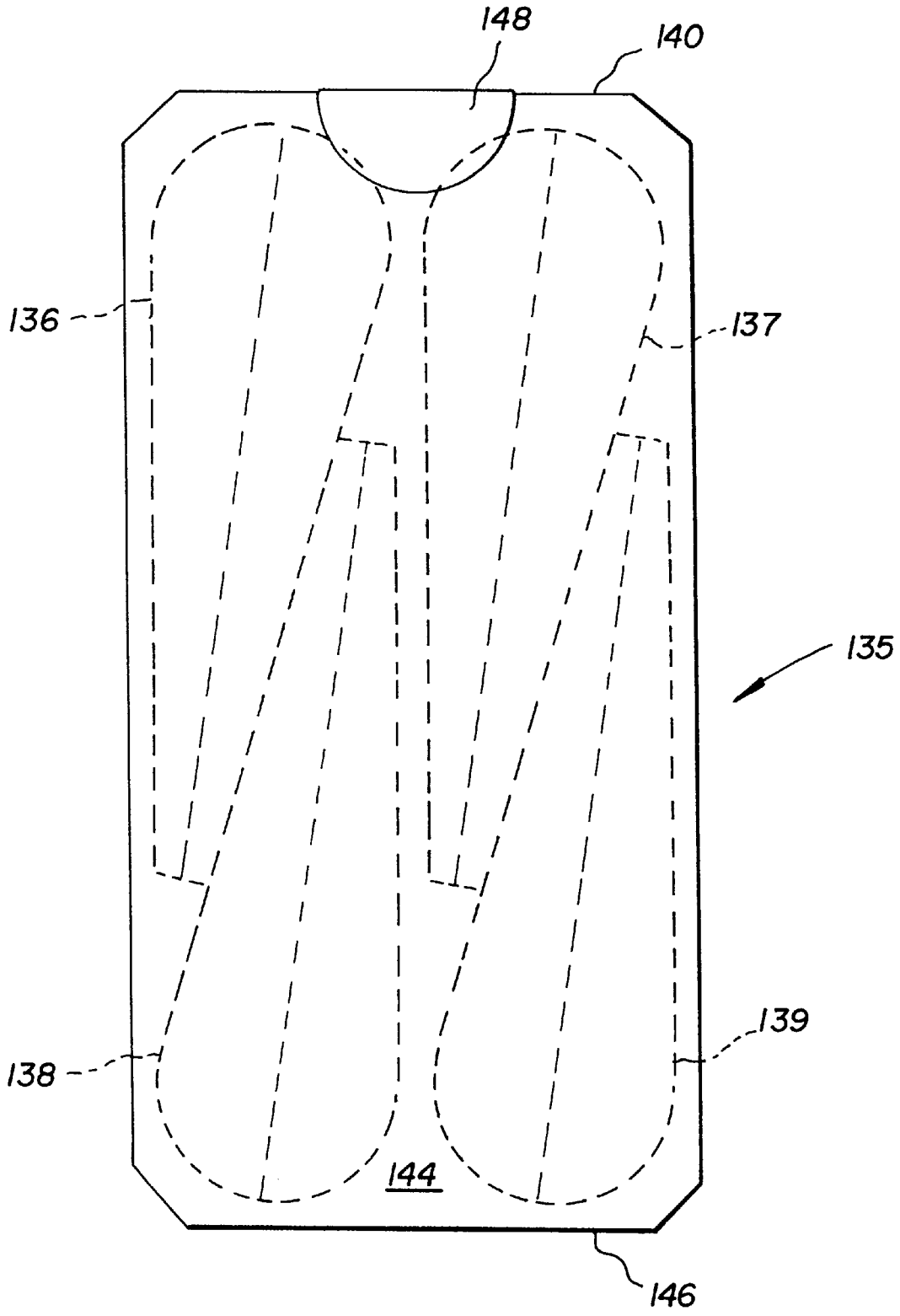
FIG. 10 shows one of the blanks of FIG. 9, folded up into a spoon insert as it would be utilized in a sleeve-type package.

Another important advantage of this embodiment is the arrangement of the panels end to end rather than side by side. With the hinges at the short ends of the rectangle, in the folded condition as shown in FIG. 10 (to be described in greater detail below) both of the short ends of the spoon insert which are exposed at the ends of the sleeve package are covered, one by a hinge and another by the adhesive tab 148. The exposed longer sides are now located entirely within the sleeve-type package. This arrangement has the significant advantage of essentially closing off the interior of the spoon insert and hence the spoons themselves from the atmosphere and thus eliminating intrusion of dust. The location of the spoons themselves away from the edges of the spoon panel also assist in reducing the ability of dust to reach the spoons. This is because the pressing together of the panels by the containers of the package creates a poly to poly contact which makes an excellent seal.

In any embodiment wherein the spoons are located in a separate spoon panel inwardly from the edges thereof, instead of using an adhesive tab, the panels can be held together by a hot melt adhesive suitably placed so as not to engage the spoons.

As in previously described embodiments and as described in greater detail below, the spoons themselves are surrounded by easily separable lines, as shown at dotted lines, and these include a center fold line 141.

FIG. 10 illustrates a single spoon insert 135 of FIG. 9 after being folded into a spoon insert to be inserted into the sleeve 12. The spoon panel 149 is folded along fold line 140 away from the viewer and against the opposite side of protective panel 144. The panel 145 is then folded downwardly away from the viewer along fold line 146 against the fronts of the spoons, after which adhesive tab 148 is attached over fold line 140 to the panel 144.

Figure 11:
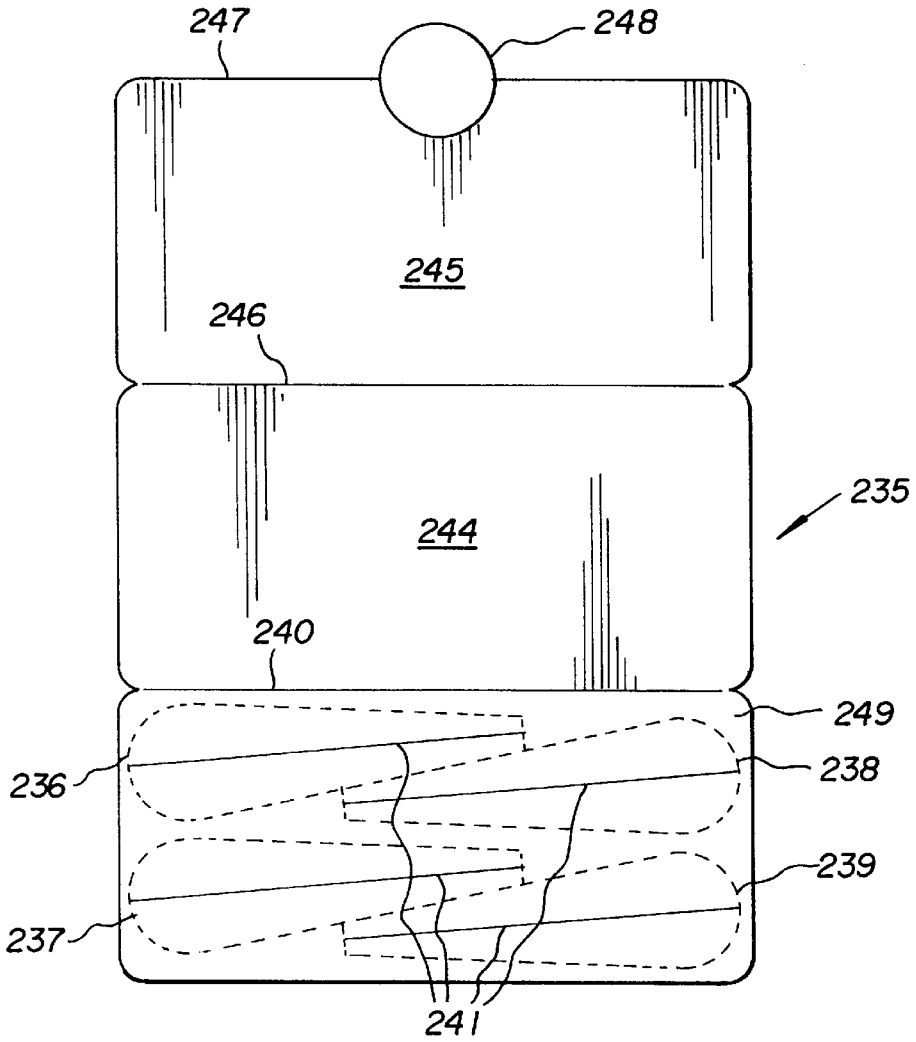
FIG. 11 shows a blank of another embodiment of a spoon insert.
Figure 12:
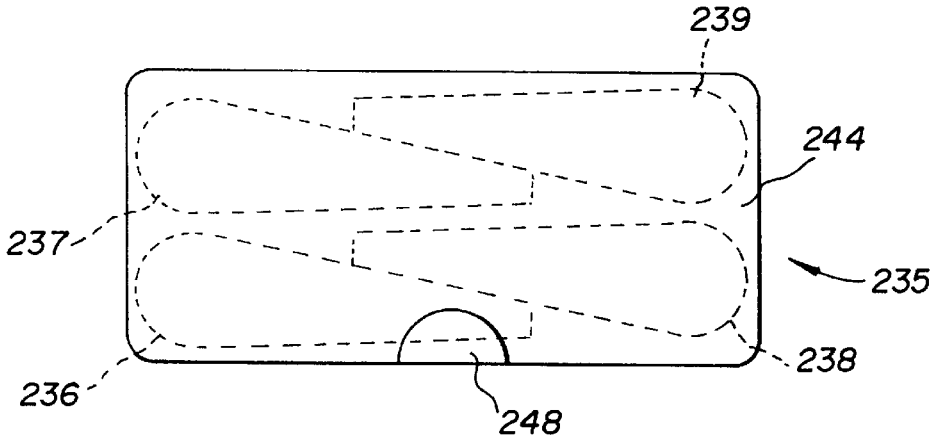
FIG. 12 shows the blank of FIG. 11, folded up into a spoon insert as it would be utilized in the sleeve-type package.

FIG. 11 illustrates another embodiment 235 of a spoon blank. This spoon blank is similar to the embodiment shown in FIGS. 5 and 6 in that it includes three panels foldable along the long sides. However, in the embodiment of FIG. 11, the four spoon blanks 236, 237, 238 and 239 are arranged within the borders of their respective spoon panel 249 which provides the advantages described above with respect to the embodiment of FIGS. 9 and 10. To fold this embodiment into the spoon insert shown in FIG. 12, the spoon panel 249 is folded away from the viewer about fold line 240 until the panel 249 engages the opposite side of panel 244. Panel 245 is then folded away from the viewer about fold line 246 to cover the spoon panel 249. Adhesive tab 248 is then attached to the panel 244. As described above and below, the individual spoons are connected to the spoon panel 249 by weakened lines allowing each respective spoon to be separated from its spoon panel. Solid lines 241 represent a fold line in the center of each spoon.

Figure 13:
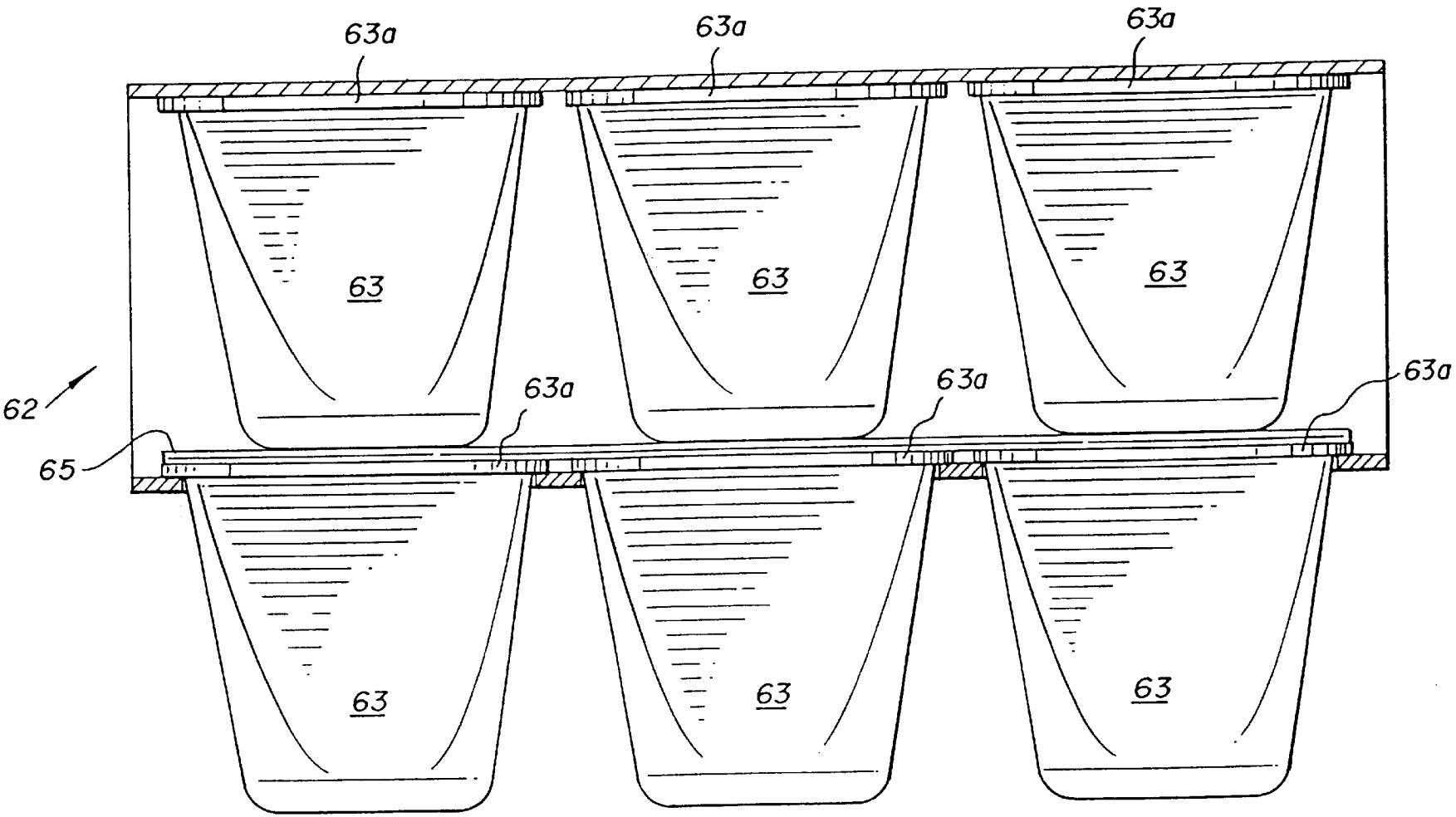
FIG. 13 is a central cross-sectional view of a sleeve-type package similar to FIGS. 1–4, but having three containers in each of the upper and lower rows.

FIG. 13 illustrates a sleeve-type package similar to that shown in FIGS. 1–4 except that it includes six containers instead of four. Here, the sleeve-type package 62 comprises three upper and three lower containers 63, each with a top 63*a*. The embodiment of FIG. 13 is identical to that of FIGS. 1–4 except for the added length required for the two additional containers.

FIG. 14 illustrates another embodiment 65 of a spoon insert, this one suitable for the package of FIG. 13. In this embodiment, six spoons 67, 68, 69, 70, 71 and 72 are formed in a spoon panel 85. To provide room for six spoon blanks, three spoons are arranged side by side at each end. The lines between or around the individual spoon blanks are weakened to allow each spoon to be easily removed from the spoon panel. Each spoon includes a central fold line 73.

Adjacent the spoon panel is a first protective panel 77 separated by a fold line 79 from a second protective panel 78 which terminates along edge 80.

The embodiment of FIG. 14 is folded as shown in FIG. 15 to form the spoon insert to be inserted into the sleeve-type package. First, the panel 85 is folded along fold line 74 away from the viewer, away from the plane of the figure and against the back of panel 77. It will be noted that the width of panel 85 is slightly less than the width of panels 77 and 78 which are of equal width to each other. Next, the panel 78 is folded away from the viewer, away from the plane of the figure and over to cover the spoon panel 85. The adhesive tab 81 then secures the panel 78 to the panel 77 with the spoon panel secured therebetween.

Figure 16:
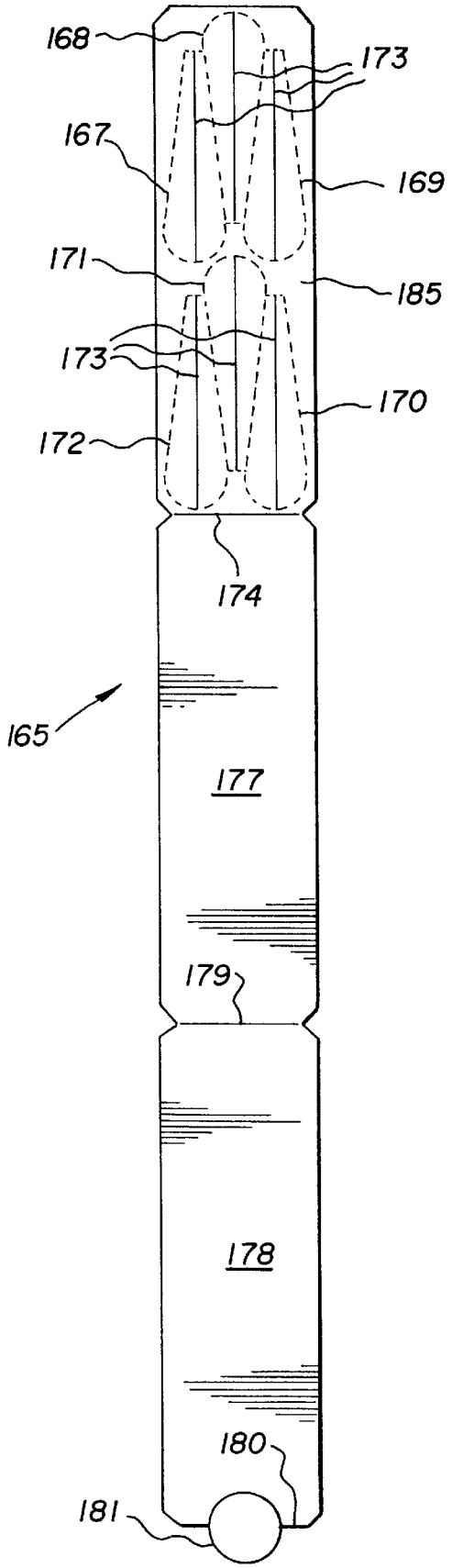
FIG. 16 shows another embodiment of a blank of a spoon insert, this one suitable for the sleeve-type package with six containers.

FIG. 16 illustrates another embodiment 165 of a spoon blank, this one, like the embodiment of FIG. 14, suitable for the package of FIG. 13. The numerals in FIG. 16 which correspond to the numerals in FIG. 14 are the same, except raised by 100.

The embodiment of FIG. 16, like the embodiment of FIG. 9, connects the different panels end to end rather than side by side. This embodiment achieves all of the advantages described above with respect to the embodiment of FIG. 9, except that it includes six spoons 167,168, 169, 170, 171 and 172 and is intended to form a spoon insert for insertion into the larger package as shown in FIG. 13 containing six containers. These spoon blanks 165 with the panels arranged end to end may also be initially manufactured in pairs as shown in FIG. 9 in which case it would have all of the advantages described therein.

Figure 17:
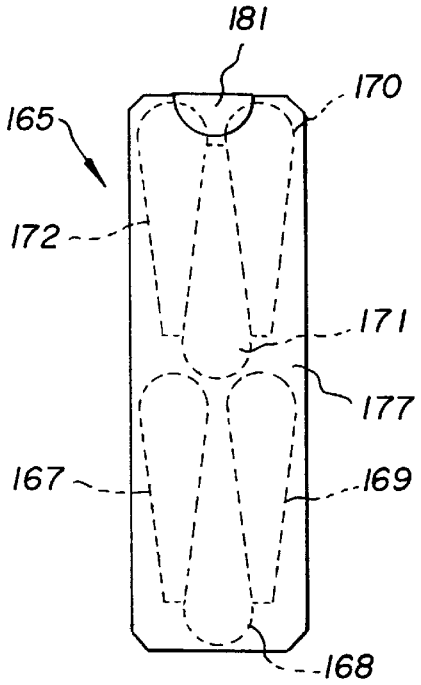
FIG. 17 shows the blank of FIG. 16, folded up into a spoon insert as it would be utilized in the sleeve-type package of FIG. 13.

FIG. 17 illustrates the spoon blank of FIG. 16, folded up into a spoon insert for insertion into a sleeve-type package. First the spoon panel 185 is folded away from the viewer about fold line 174 until it engages the opposite side of panel 177. The panel 178 is then folded away from the viewer about fold line 179 until it engages the spoon panel 185. Tab 181 then connects the edge 180 of panel 178 to the edge 174 of panel 177.

FIG. 18 illustrates another embodiment 265 of a spoon blank. This spoon blank is intended for the six container package of FIG. 13 and is similar in almost all respects to the embodiment shown in FIG. 14 except that the spoons themselves have a different arrangement within their spoon panel. All numerals in FIG. 18 which correspond to the numerals in FIG. 14 have been raised by 200.

FIG. 19 illustrates the spoon blank 265 folded into a spoon insert for insertion into the sleeve-type package of FIG. 13. The spoon panel 285 is folded away from the viewer about fold line 274 against the opposite side of panel 277. The panel 278 is then folded away from the viewer about fold line 279 until the panel 278 engages the spoon panel 285. The adhesive tab 281 then connects the edge 280 of panel 278 to the edge 274 of panel 277.

Fold lines and weakened tear lines are formed in the conventional manner. For example, the fold lines would include a scoring of between 60% to 90% of the thickness of the blank, without going completely through. Weakened lines would include for example a series of perforations through the thickness of the blank of suitable length and separated by suitable distances. The spoon insert can be made of any suitable material which provides sufficient stiffness to withstand handling of the package and to be folded up to form an operable spoon. Cardboard would be the preferred material, although suitable plastic materials might also be used.

Although the invention has been described in considerable detail, it will be apparent that numerous variations and modifications are apparent to those skilled in the art, without departing from the spirit and scope of the invention.

We claim:

1. A sleeve-type package comprising a tubular sleeve of generally rectangular cross section, upper and lower rows of containers, the containers of the upper row being located within the sleeve and the containers of the lower row located beneath respective containers of the upper row with their tops located within the sleeve and with their main portions extending downwardly through openings in the bottom of the sleeve, and a generally flat spoon insert located within the sleeve, between the upper and lower rows, said spoon insert comprising at least one spoon panel having a plurality of flat spoon blanks, and at least one protective panel covering all of the spoon blanks of the spoon panel.

2. A package according to claim 1, said spoon insert being of a length and width essentially equal to the length and width of the interior of the rectangular sleeve.

3. A package according to claim 1, wherein said spoon insert includes a single protective cover.

4. A package according to claim 1, said spoon panel comprising at least as many spoon blanks as there are containers in the sleeve-type package.

5. A package according to claim 1, including two containers in each of the upper and lower rows.

6. A package according to claim 5, the spoon panel comprising four spoon blanks, each having a large end and a narrow end, and a fold line down the center line of each spoon blank, the four spoon blanks arranged side by side and a protective panel overlying all of the spoon blanks of the spoon panel.

7. A package according to claim 5, including a second protective panel connected to the first protective panel and lying over the other side of the spoon panel.

8. A package according to claim 7, each of the panels being generally rectangular and connected together along their short sides with the spoon panel at one end and the second protective panel at the other end.

9. A package according to claim 7, each of the panels being generally rectangular in shape and connected together along their long sides with the spoon panel at one end and the second protective panel at the other end.

10. A package according to claim 7, including three containers in each of the upper and lower rows.

11. A package according to claim 10, wherein the spoon panel comprises six spoon blanks, each having a large end and a narrow end, and a fold line down the center of each spoon blank, three spoon blanks arranged at each end of the spoon panel.

12. A package according to claim 10, including a second protective panel connected to the first protective panel and lying over the opposite side of the spoon panel.

13. A package according to claim 12, each of the panels being generally rectangular and connected together along their short sides with the spoon panel at one end and the second protective panel at the other end.

14. A package according to claim 12, each of the panels being generally rectangular in shape and connected together along their long sides with the spoon panel at one end and the second protective panel at the other end.

15. A package according to claim 1, including a spoon panel and a pair of protective panels connected together and one overlying each side of the spoon panel.

16. A package according to claim 15, including an adhesive tab connecting the protective panels together on opposite sides of the spoon panel.

17. A spoon insert blank comprising, a spoon panel with a plurality of flat spoon blanks removably formed therein by tear lines at least partially connecting each flat spoon blank to the remainder of the spoon panel, and at least one protective panel connected to the spoon panel and being foldable about a fold line to be essentially coextensive with the spoon panel.

18. A spoon insert blank according to claim 17, the spoon panel and one protective panel connected at a fold line.

19. A spoon insert blank according to claim 18, including a second protective panel connected to the side of the first protective panel opposite from the spoon panel.

20. A spoon insert blank according to claim 19, wherein each of the panels are rectangular and connected together along their short sides with the spoon panel at one end and the second protective panel at the other end.

21. A spoon insert blank according to claim 19, wherein each of the panels are rectangular and connected together along their long sides with the spoon panel at one end and the second protective panel at the other end.

22. A spoon insert blank according to claim 17, including four spoon blanks arranged side by side in the spoon panel.

23. A spoon insert blank according to claim 22, each spoon blank having a large end and a narrow end, and the spoon blanks arranged side by side with the direction of the large end and the small end alternating.

24. A spoon insert blank according to claim 23, including six spoon blanks in the spoon panel.

25. A spoon insert blank according to claim 24, including three spoon blanks side by side at one end of the spoon panel and another three spoon blanks arranged side by side at the other end of the spoon panel.

26. A sleeve-type package comprising a tubular sleeve of generally rectangular cross section, a plurality of individual sealed product containers held by the sleeve, each container having a generally flat top and a body portion extending below the top and having a smaller cross section than the top, a top row of said containers located within the rectangular sleeve and a bottom row of containers arranged one below each container of the top row, and a rigid spoon insert comprising at least two panels and located between the upper and lower rows, the insert having a length and a width corresponding essentially to the length and width of the interior of the rectangular sleeve, one of said panels having a plurality of spoon blanks, and the other being an overlying protective panel.

27. A package according to claim 26, including two containers in each of the two upper and lower rows.

28. A package according to claim 27, including four spoon blanks in the spoon panel.

29. A package according to claim 26, including three containers in each of the upper and lower rows.

30. A package according to claim 29, including six spoon blanks in the spoon panel.

31. A package according to claim 26, including a second protective panel adjacent to the first protective panel such that the spoon panel is foldable between the two protective panels.

32. A package according to claim 31, each of the panels being generally rectangular and connected together along their short sides with the spoon panel at one end and the second protective panel at the other end.

33. A package according to claim 31, each of the panels being generally rectangular in shape and connected together along their long sides with the spoon panel at one end and the second protective panel at the other end.

* * * * *